US007318709B2

(12) United States Patent
Koelzer et al.

(10) Patent No.: US 7,318,709 B2
(45) Date of Patent: Jan. 15, 2008

(54) PUMP VALVE ASSEMBLY

(75) Inventors: Robert L. Koelzer, Kearney, MO (US); Michael R. Jenkins, Kansas City, MO (US)

(73) Assignee: Haldex Brake Corporation, Kansas City, MO (US)

( * ) Notice: Subject to any disclaimer, the term of this patent is extended or adjusted under 35 U.S.C. 154(b) by 620 days.

(21) Appl. No.: 10/648,881

(22) Filed: Aug. 27, 2003

(65) Prior Publication Data

US 2005/0047928 A1 Mar. 3, 2005

(51) Int. Cl.
*F04B 23/00* (2006.01)

(52) U.S. Cl. ..... 417/441

(58) Field of Classification Search ..... 417/222.2, 417/441, 269

See application file for complete search history.

(56) References Cited

U.S. PATENT DOCUMENTS

| | | | | | |
|---|---|---|---|---|---|
| 919,036 | A | | 4/1909 | Langer | |
| 4,715,790 | A | * | 12/1987 | Iijima et al. | 417/269 |
| 4,730,987 | A | * | 3/1988 | Kawai et al. | 417/270 |
| 4,776,776 | A | | 10/1988 | Jones | 417/560 |
| 4,911,614 | A | * | 3/1990 | Kawai et al. | 417/269 |
| 5,259,736 | A | * | 11/1993 | Terauchi | 417/222.1 |
| 5,586,874 | A | | 12/1996 | Hashimoto et al. | 417/569 |
| 5,603,611 | A | | 2/1997 | Tarutani et al. | 417/269 |
| 5,709,535 | A | * | 1/1998 | Enomoto et al. | 417/269 |
| 6,434,956 | B1 | * | 8/2002 | Ota et al. | 62/133 |
| 6,439,857 | B1 | | 8/2002 | Koelzer et al. | 417/222.1 |

FOREIGN PATENT DOCUMENTS

| | | |
|---|---|---|
| WO | WO99/14493 | 3/1999 |

* cited by examiner

*Primary Examiner*—Anthony Stashick
*Assistant Examiner*—Vikansha Dwivedi
(74) *Attorney, Agent, or Firm*—St. Onge Steward Johnston & Reens LLC

(57) ABSTRACT

A valve assembly is disclosed generally comprising first and second valve plates mounted between the housing for a pump mechanism and a cover, the first plate having flexing flaps corresponding to apertures in the second plate, and the second plate having flexing flaps corresponding to apertures in the first plate. The flexing flaps and apertures create inlet and outlet valves for fluid being received into and discharged from the pump mechanism. In some embodiments, the valves facilitate the flow of air received and discharged through inlet and outlet ports in a compressor head. In some embodiments, the valves facilitate the flow of air received from an inlet port in a compressor housing.

17 Claims, 5 Drawing Sheets

PUMP VALVE ASSEMBLY

FIELD OF THE INVENTION

The present invention relates to an apparatus for providing valves for a pump mechanism. More specifically, the invention relates to a pair of plates with corresponding apertures and flaps for creating a valve assembly.

BACKGROUND OF THE INVENTION

Various pump mechanisms for moving or compressing air in a vehicle are well known. A common example of such mechanisms is a piston compressor for generating compressed air for a variety of devices in the motor vehicle. These compressors typically include a drive shaft, a cylinder block surrounding the drive shaft, which cylinder block has a plurality of cylinder bores or channels formed therein, a swash plate mounted on the drive shaft, and a plurality of pistons coupled to the swash plate and slidably disposed in the cylinder bores. These pistons are successively reciprocated in the cylinder channels as the drive shaft rotates so that a suction stroke and a discharge stroke are alternately executed in each of the cylinder channels. One such device is disclosed in U.S. Pat. No. 6,439,857, which is assigned to the assignee of the present application and which is incorporated herein by reference, which describes a swash plate compressor employing pistons disposed in channels of a stationary cylinder block, wherein a non-rotatable swash plate pivots in accordance with the thrust exerted by an actuator.

In these types of compressors, a space in the cylinder channel above the pistons is in fluid communication with the air system of the vehicle via inlet and outlet ports. Accordingly, the air pressure in the space in the channels corresponds to air pressure in the air system, thereby ensuring a state of pressure equilibrium for the compressor.

In order to alternately provide fluid communication and provide a seal between the inlet and outlet ports and the cylinder channels, the compressor is provided with a plurality of one-way check valves which prevent the backfeeding of the air. These valves are often of the reed variety, such as those disclosed in U.S. Pat. No. 5,586,874 to Hashimoto and U.S. Pat. No. 5,603,611 to Tarutani, allowing air to flow along a path from a high-pressure area to a low-pressure area. Thus, as the pressure in the air system downstream from the compressor lowers, airflow is directed from the cylinder channels to the air system through the valves provided at the outlet ports. Accordingly, air pressure above the pistons is lowered, thereby causing displacement of the swash plate and the pistons. As a result, the suction stroke generates a negative pressure sufficient to allow air to enter the cylinder block through the valves provided in the inlet port.

One disadvantage of these valve assemblies, however, is that they often provide check valves for only one direction of air flow, or are expensive to manufacture, or both. In order to operate at maximum efficiency, a piston compressor must provide a one-way valve both for air entering and for air exiting the cylinder channels. Such compressors require a compressor head assembly including multiple valves, some of which operate exclusively in a direction opposite to the direction in which some of the other valves exclusively operate. These arrangements are generally costly to manufacture. Additionally, such assemblies often prove to be somewhat difficult to assemble with the rest of the compressor.

What is desired, therefore, is an apparatus that provides inlet and outlet valves in a compressor that is inexpensive to manufacture. What is further desired an apparatus that provides inlet and outlet valves that is easy to assemble with the rest of a compressor.

SUMMARY OF THE INVENTION

Accordingly, it is an object of the invention to provide a valve assembly that can be manufactured inexpensively.

It is a further object of the invention to provide a valve assembly that is easy assembled with the other parts of a compressor.

To overcome the deficiencies of the prior art and to achieve at least some of the objects and advantages listed, the invention comprises a valve assembly, including a housing, a pump mechanism disposed in the housing, a first plate mounted adjacent to the pump mechanism, the first plate having at least one aperture and at least one flexing flap, a second plate mounted adjacent to the first plate, the second plate having at least one aperture and at least one flexing flap, wherein the first and second plates are aligned such that the at least one aperture in the first plate is located adjacent the at least one flexing flap in the second plate and the at least one aperture in the second plate is located adjacent the at least one flexing flap in the first plate, a cover mounted to the housing to substantially enclose the pump mechanism and the first and second plates, and at least one outlet port in the cover for discharging fluid that has passed through the plates.

In another embodiment, the invention comprises a valve assembly, including a housing, a pump mechanism disposed in the housing, a first plate mounted adjacent to the pump mechanism, the first plate having at least one aperture and at least one flexing flap, a second plate mounted adjacent to the first plate, the second plate having at least one aperture and at least one flexing flap, a cover mounted to the housing to substantially enclose the pump mechanism and the first and second plates, at least one inlet port in the cover for introducing fluid that is to be passed through the plates, at least one outlet port in the cover for discharging fluid that has passed through the plates, a first fluid pathway defined when the at least one flexing flap of the second plate is disposed against the at least one aperture of the first plate and the at least one flexing flap of the first plate is biased away from the at least one aperture of the second plate, in which fluid flows through the inlet port, through the at least one aperture in the second plate, past the at least one flexing flap in the first plate, and into the housing, and a second fluid pathway defined when the at least one flexing flap of the first plate is disposed against the at least one aperture of the second plate and the at least one flexing flap of the second plate is biased away from the at least one aperture of the first plate, in which fluid flows from the housing, through the at least one aperture in the first plate, past the at least one flexing flap in the second plate, and out the outlet port.

In yet another embodiment, the invention comprises a valve assembly, including a swash plate housing at least partially enclosing a swash plate chamber, a cylinder block mounted to the swash plate housing, the cylinder block having at least one passageway and at least one piston channel, a pump mechanism disposed in the swash plate housing and cylinder block, a first plate mounted adjacent to the cylinder block, the first plate having at least one aperture and at least one flexing flap, a second plate mounted adjacent to the first plate, the second plate having at least one aperture and at least one flexing flap, a cover mounted to the housing to substantially enclose the pump mechanism and the first and second plates, at least one inlet port in the swash plate housing for introducing fluid that is to be passed through the plates, at least one outlet port in the cover for discharging fluid that has passed through the plates, a first fluid pathway defined when the at least one flexing flap of the second plate is disposed against the at least one aperture of the first plate and the at least one flexing flap of the first plate is biased away from the at least one aperture of the second plate, in which fluid flows through the inlet port and into the swash plate chamber, through the passageway, into the cover, through the at least one aperture in the second plate, past the at least one flexing flap in the first plate, and into the piston channel, and a second fluid pathway defined when the at least one flexing flap of the first plate is disposed against the at least one aperture of the second plate and the at least one flexing flap of the second plate is biased away from the at least one aperture of the first plate, in which fluid flows from the piston channel, through the at least one aperture in the first plate, past the at least one flexing flap in the second plate, and out the outlet port.

DETAILED DESCRIPTION OF THE DRAWINGS

Figure 1:
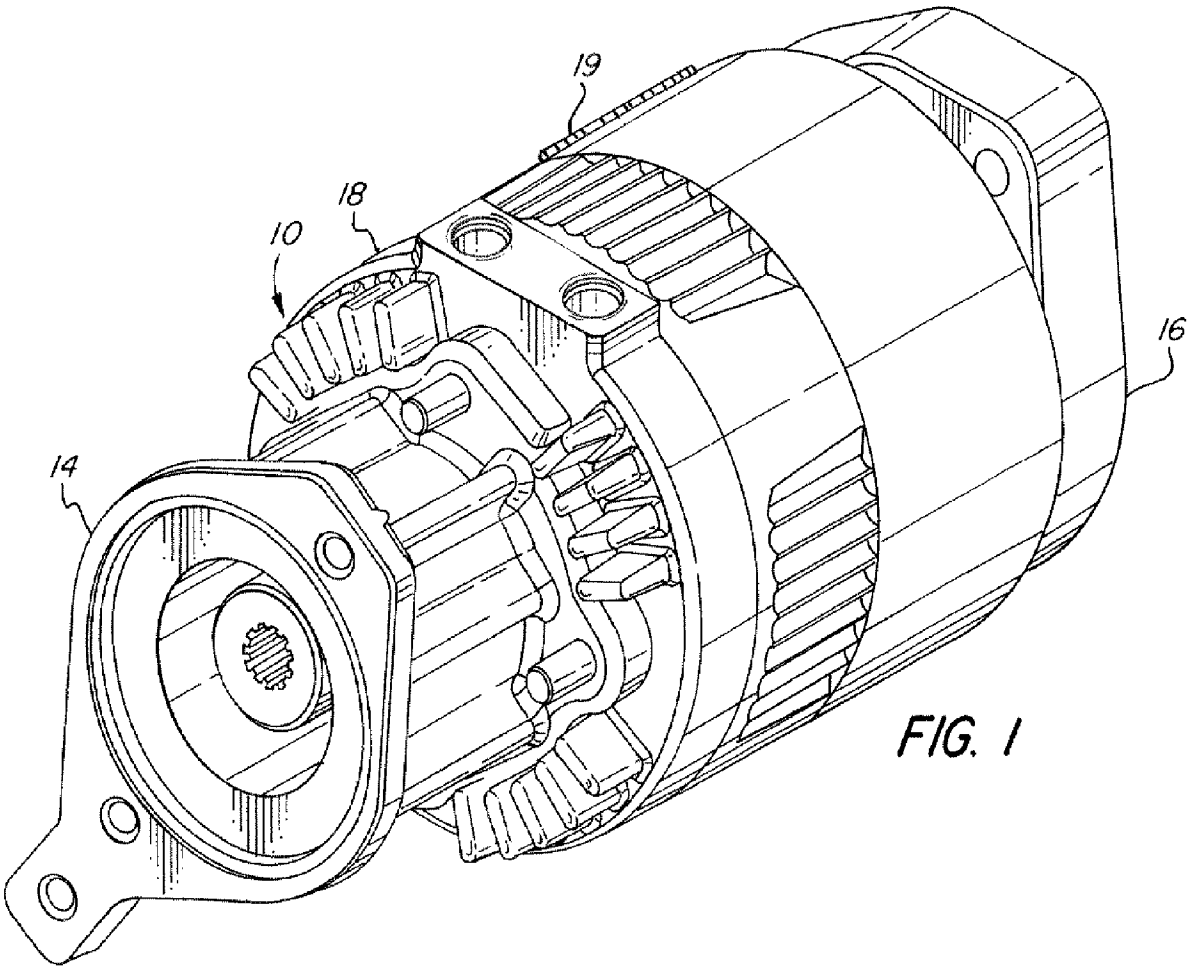
FIG. 1 is an isometric view of the piston compressor provided with the valve assembly in accordance with the invention.

The basic components of one embodiment of a piston compressor 10 in accordance with the invention are illustrated in FIG. 1. As used in the description, the terms "top," "bottom," "above," "below," "up," "down," "upper," "lower," "front" and "rear" refer to the objects referenced when in the orientation illustrated in the drawings, which orientation is not necessary for achieving the objects of the invention.

Typically, the compressor 10 includes a housing 19 having first and second portions 20, 26, a cover or compressor head 18, a rear mounting cover 14, and a front mounting flange 16. When in use, the compressor 10 is installed on a vehicle, such as an over-the-road truck, and generates compressed air for the vehicle's pressure system, which typically includes a tank (not shown) that supplies the compressed air to various accessories, such as, for example, the brake system. This production of the compressed air begins by receiving air, which may or may not be delivered from a turbocharger (not shown), in response to a reduction of the air pressure in the air system to or below a reference pressure.

Figure 2:
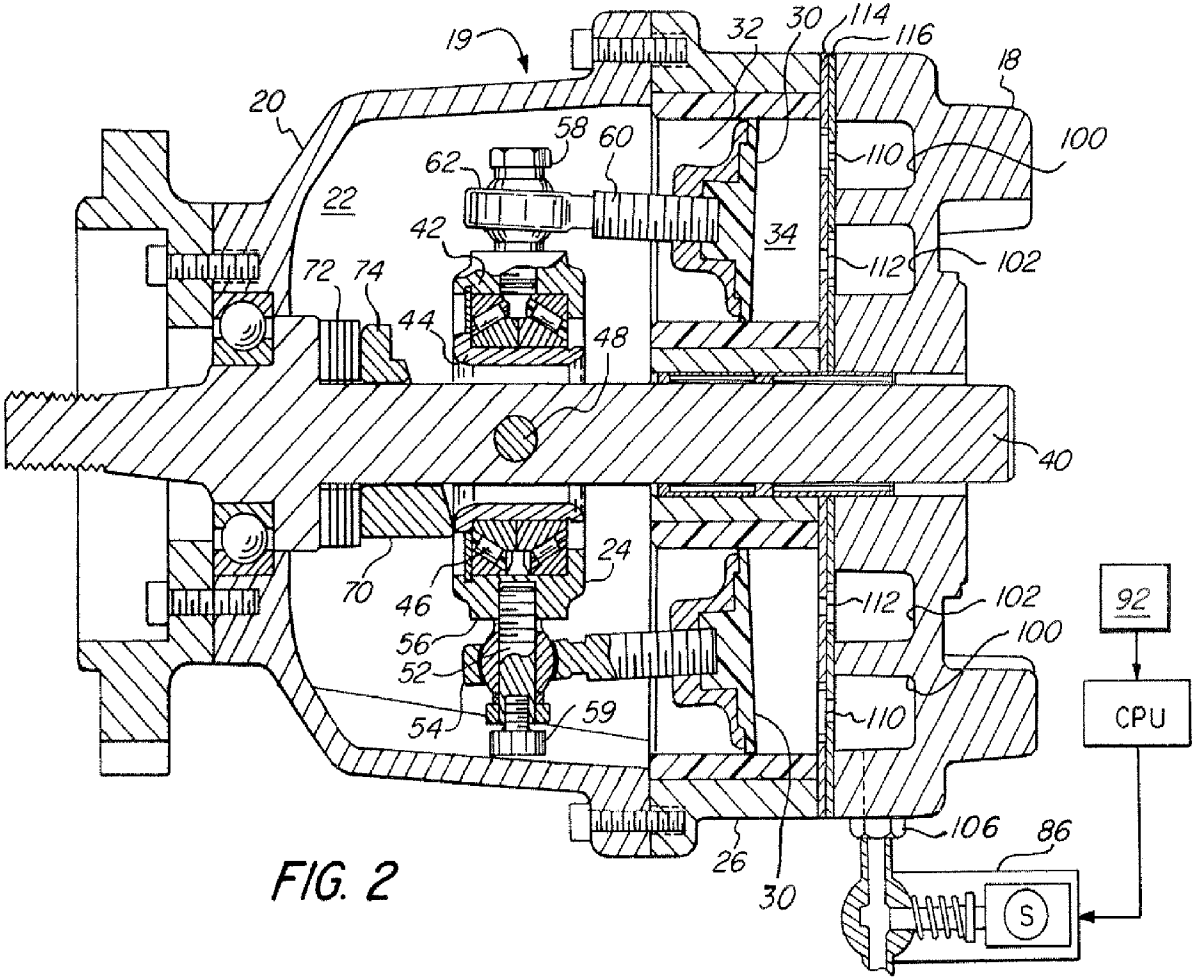
FIG. 2 is an exposed elevational view of the compressor of FIG. 1.
Figure 3:
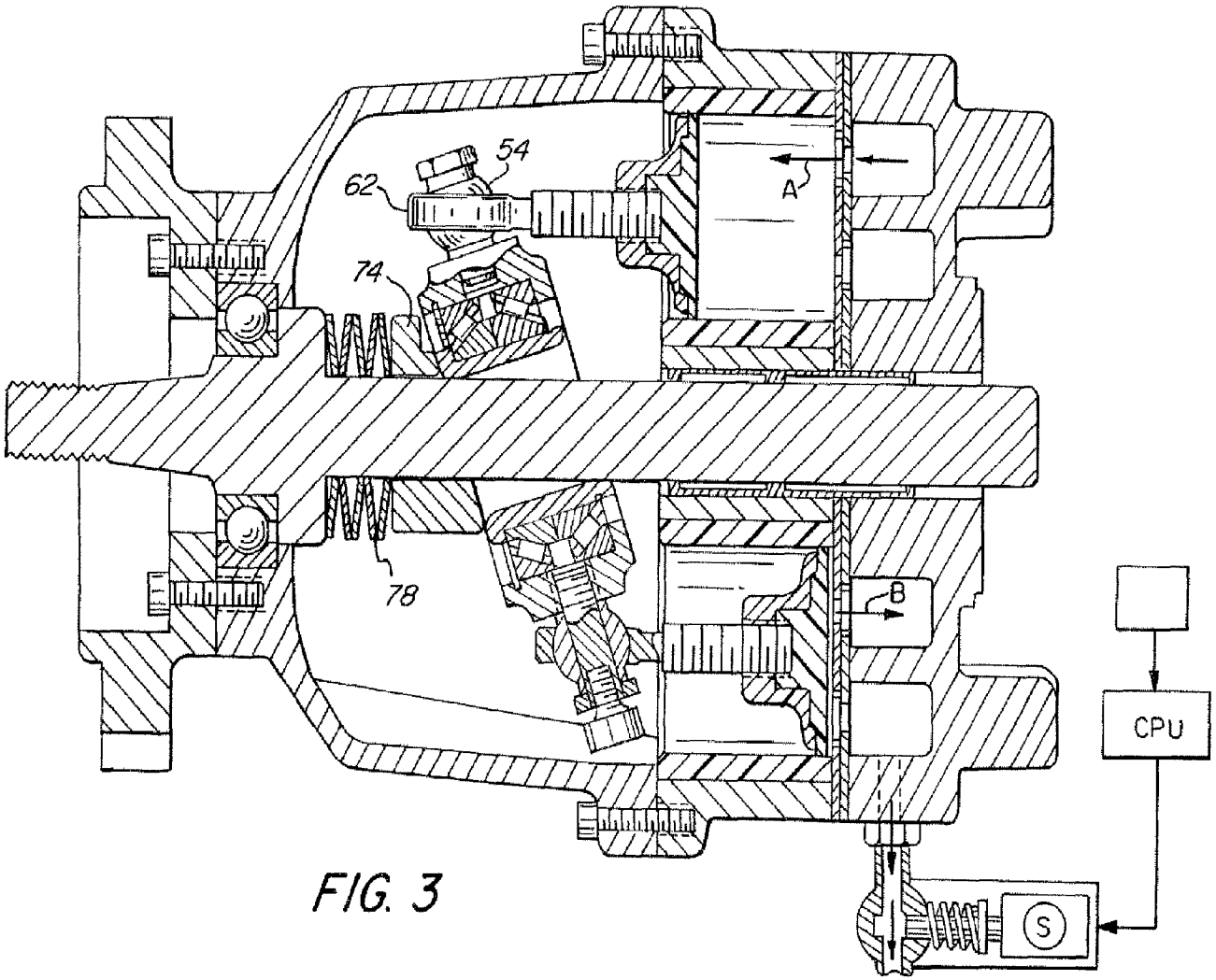
FIG. 3 is an exposed elevational view of the compressor of FIG. 1 in a different position.

Referring to FIGS. 2-3, the second portion of the housing 19 comprises a swash plate housing 20 that defines a swash plate chamber 22 therein, in which a swash plate 24 is disposed. The first portion of the housing 19 comprises a cylinder block 26 that has a plurality of piston channels 32. A plurality of pistons 30 are coupled to the swash plate 24 and are disposed in the piston channels 32. The pistons 30 are reciprocally displaceable within the channels 32 in order to provide for suction and compression strokes. A space 34 in the channels 32 above the pistons 30 is in fluid communication with the air system via a inlet channel 100 and outlet channel 102 in the cover 18, as is further described below. Accordingly, the air pressure in the space 34 corresponds to air pressure in the air system, ensuring a state of pressure equilibrium for the compressor 10, as is further explained below.

The swash plate 24 and cylinder block 26 each have a hole in the center thereof, which, collectively, form a channel in which a drive shaft 40 is disposed. The entire swash plate 24 is pivotal with respect to the shaft 40. A mechanism for translating pivotal displacement of the swash plate 24 to reciprocal axial displacement of the pistons 30 includes a plurality of ball links, each of which is comprised of a rod 52 and a ball element 54. In certain embodiments, the rods 52, which are spaced angularly equidistantly from one another along an outer periphery of the swash plate 24 and extend radially therefrom, are bolts having a thread 56 on one end and a nut 58 on the opposite end. The ball element 54 has a spherical outer surface slidably engaging a piston rod 60, which extends parallel to the rotating shaft 40, for synchronous axial displacement while allowing the piston rod 60 and ball element 54 to be angularly displaced relative to one another.

To displace the pistons 30 and swash plate 24 relative to one another as the swash plate 24 pivots, each piston rod 60 has a flange 62, the inner surface of which cooperates with an outer extremity of the ball element 54. Accordingly, as the swash plate 24 is angularly displaced from a position perpendicular to the drive shaft 40, the cooperating surfaces of the ball element 54 and flange 62 slide relative to one another. Such relative displacement allows the piston rod 60 and ball element 54 to move axially together, while the ball element 54 rotates within the flange 62 in response to the angular motion of the swash plate 24. Though the cooperating surfaces of the ball element 54 and flange 62 are depicted as annular, in certain embodiments, other shapes that move synchronously while being angularly displaced relative to one another may be used.

Because the drive shaft 40 is rotatably disposed in the swash plate 24, rather than integrally formed therewith, the shaft 40 continues to rotate even when the pistons 30 are idle and the compressor 10 is not compressing air. As a consequence, accessories coupled to the shaft 40, such as, for example, a fuel pump, continue to function.

In certain advantageous embodiments, this arrangement is achieved by employing a swash plate 24 having an outer part 42 connected to a rotatable inner part 44 via a bearing assembly 46. The inner part 44 is mounted on the shaft 40 via a pin 48, such that the inner part 44 rotates with the shaft 40. As a result, as the shaft 40 rotates, the outer part 42 of the swash plate 24 can be restrained from rotating with the shaft 40. In certain embodiments, in order to prevent the outer part 42 from rotating, the swash plate receives a radially extending stopper 59 that engages an axial groove of the housing 20. In other embodiments, a gimbal arm (not shown) may be used to prevent the outer part 42 from rotating.

The pistons 30 are idle in a state of pressure equilibrium when a piston-generated force acting upon a swash plate 24 and corresponding to the air pressure in the space 34 above the pistons 30 is equal and oppositely directed to a thrust generated by an actuator 70 against the swash plate 24. This state of equilibrium occurs when the swash plate 24 is in a substantially perpendicular position with respect to the axis of a drive shaft 40. Once the balance of air pressure has been disturbed, the thrust from the actuator 70 exceeds the lowered piston-generated force to angularly displace the swash plate 24 from its perpendicular position. As a result, the pistons 30 begin to reciprocally move in the channels 32, as will be further explained below. Thus, the more the air pressure in the air system drops, the larger the angular displacement of the swash plate 24 and the longer the strokes of the pistons 30.

The swash plate 24 pivots about a pin 48 upon a thrust exerted by the actuator 70. In certain advantageous embodiments, the actuator 70 includes a resilient element 72, such as, for example, Belleville washers, and a cam collar 74. The washers 72 are connected to the cam collar 74, which has a slanted cam surface with respect to the shaft 40, an extended part of which is always in contact with the swash plate 24. The swash plate 24 is always under pressure existing above the pistons 30, and thus, in order to maintain the swash plate 24 in a position perpendicular to the shaft 40 during the state of equilibrium, the cam collar 74 must continuously preload the swash plate 24. However, this contact in the state of equilibrium does not generate a thrust sufficient to overcome the pressure above the pistons 30 and pivot the swash plate 24. In operation, the washers 72 expand in response to the pressure drop in the air system to or below the reference value. As a result, the cam collar 74 is axially displaced to pivot the swash plate 24, the movement of which generates the suction and compression strokes of the pistons 30.

Although the actuator 70 is shown rotatably mounted on the shaft 40, in certain embodiments, the actuator 70 can be mounted on the housing 20. Further, in certain embodiments, other types of resilient elements, such as different types of compression springs 78, such as, for example, bellows, are used instead of the Belleville washers described above. In other embodiments, the actuator includes a servo piston (not shown), which is actuated in response to a pilot signal representing the reference value of the air system's pressure and generated by an external source once the pressure falls down to or below the threshold. The servo piston, which is attached to a mechanical link such as a fork, displaces the cam collar 74 to exert a thrust to pivotally displace the swash plate 24.

In order to allow uncompressed air to be drawn into, and to discharge compressed air out of, the compressor 10, the compressor is provided with at least one inlet channel 100 and at least one outlet channel 102. Further, in order to regulate the entry and exit of compressed and uncompressed air and prevent the back-feeding thereof, the compressor 10 is provided with a plurality of inlet and outlet valves 110, 112, respectively. These valves, which allow air to flow along a path from a high-pressure area to a low-pressure area, are one-way valves formed from a flexing flap or reed disposed against an aperture, which, as described in detail below, are created by the combination of first and second valve plates 114, 116.

Figure 4:
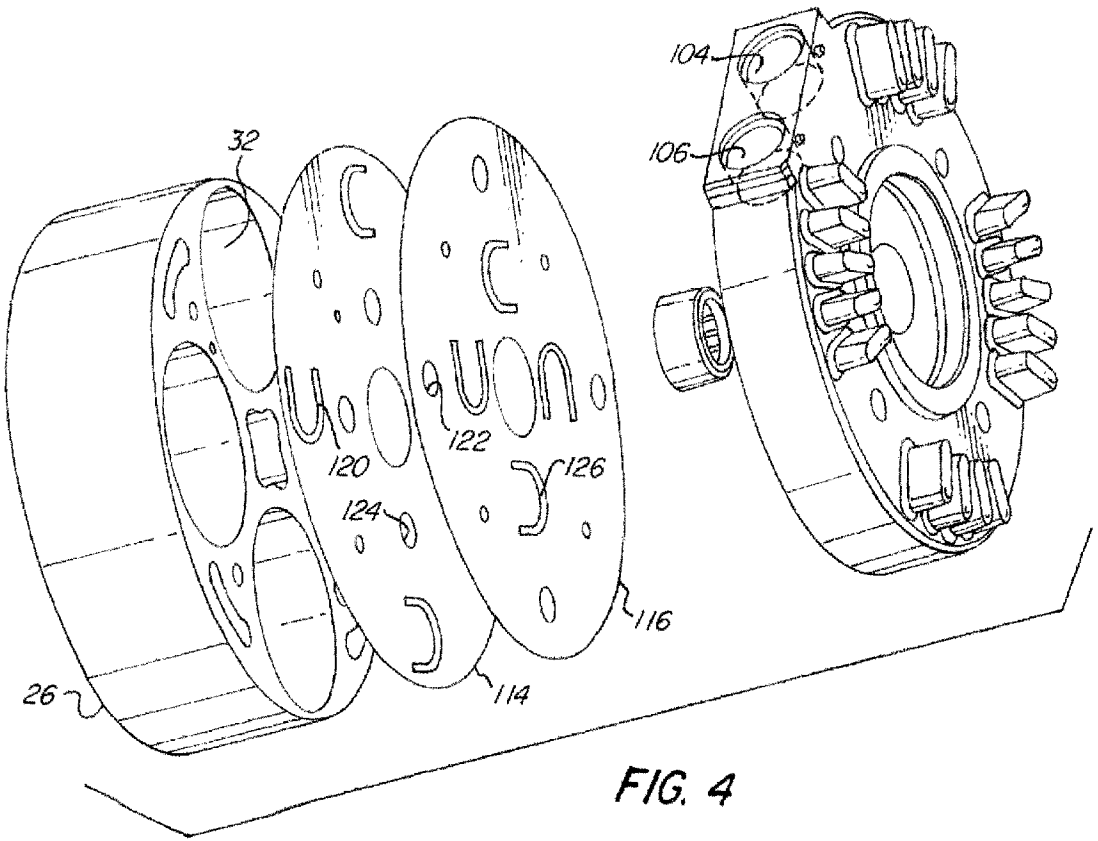
FIG. 4 is an exploded, isometric view of the valve assembly of the compressor of FIG. 1.
Figure 5:
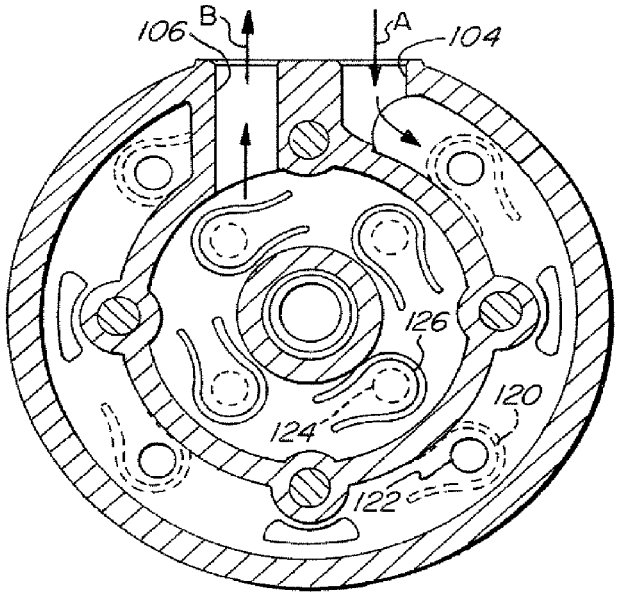
FIG. 5 is a exposed top plan view of the valve assembly of FIG. 4, when assembled.

As illustrated in FIGS. 4-5, the first valve plate 114, which has at least one flexing flap 120, is mounted adjacent the cylinder block 26. A second valve plate 116, which has at least one aperture 122 therein, is mounted adjacent the first valve plate 114. The flexing flaps 120 and apertures 122 are aligned such that the flaps 120 cover the apertures 122. Accordingly, when air to be compressed flows into the aperture 122, the air biases the flap 120 away from aperture 122, thereby permitting the air to flow into the channels 32 of the cylinder block 26. However, when this air is compressed inside the channels 32, it is unable to flow back towards the inlet channel 100, as the flap 120 is blocked by the second valve plate 116, and thus, remains pressed against the aperture 122, sealing same.

In a similar fashion, the first valve plate 114 has at least one aperture 124, whereas the second valve plate 116 has at least one flexing flap 126 therein. The apertures 124 and flexing flaps 126 are aligned such that the flaps 126 cover the apertures 124. Accordingly, when the air in the channels 32 becomes compressed, the air flows into the apertures 124 and biases the flaps 126 away from the apertures 124, thereby permitting the compressed air to be discharged into the discharge channel 102 and out an outlet port 106 to various parts of the vehicle. The flexing flaps 126, however, can only open in this direction, as they are blocked in the other direction by the first valve plate 114.

Referring to FIGS. 3 and 5, as the pressure in the air system downstream from the compressor 10 lowers, airflow is directed from the channels 32 through the outlet valves 112, into the outlet channel 102, and out the outlet port 106, and into the air system of the vehicle (indicated by arrows B). Accordingly, air pressure above the pistons 30 is lowered, thereby causing displacement of the swash plate 24 and the pistons 30. As a result, the suction stroke generates a negative pressure sufficient to draw air into the cylinder block 26 via the inlet port 104, through inlet valves 110, and into the channels 32 (indicated by arrows A).

Figure 6:
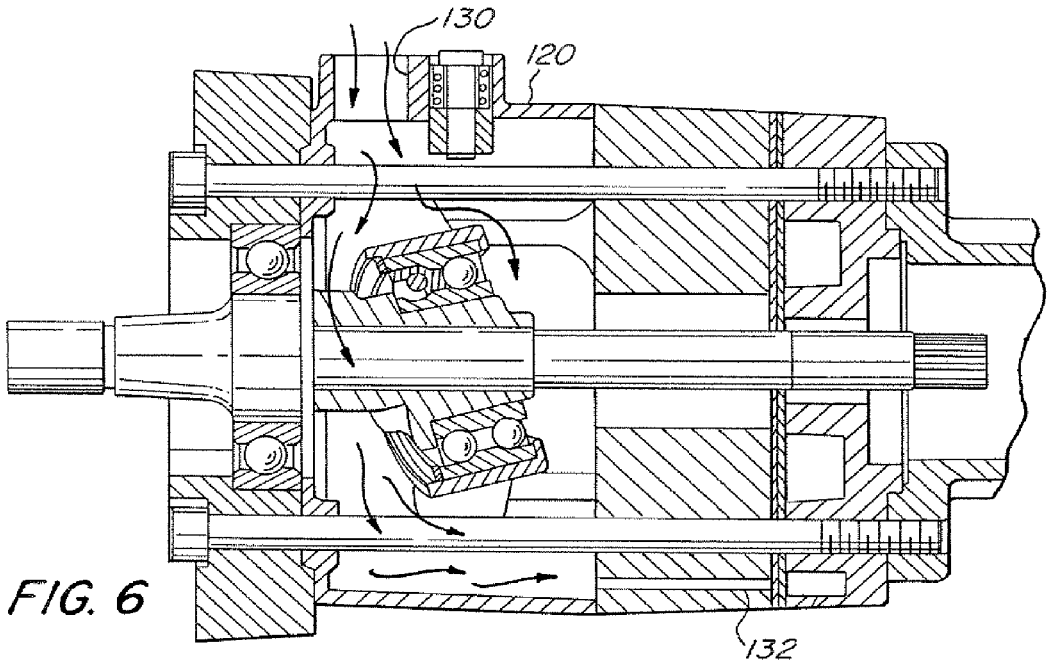
FIG. 6 is an exposed elevational view of another embodiment of the compressor of FIG. 1.

As illustrated in FIG. 6, in some embodiments, instead of an inlet port 104 in the cover 18, the housing 20 has an inlet port 130, such as may be desired in order to allow air to pass into the swash plate chamber 22, over any parts therein, and then to the channels 32 via a passageway 132. One such design is disclosed in U.S. patent application Ser. No. 10/422,268, incorporated herein by reference. This could take any of various forms, such as, for example, port cast in the side of housing 20, or, as another example, a series of small holes drilled near the bottom of housing 20. Accordingly, no inlet valve is needed in the valve plates 114, 116. In these cases, the first valve plate 114 has only apertures 124, and the second valve plate 116 has only flexing flaps 126, such that only outlet valves 112 are created.

Referring to FIG. 2, in order to temporarily release the engine of the truck from an additional load under certain conditions, such as when a truck climbs up a steep hill, a solenoid 86 can close the outlet port 106 upon an on-demand signal from a driver. As a result, the pressure in the spaces 34 above the pistons 30 rapidly rises, enabling the compressor 10 to reach a state of equilibrium within a short period of time. Opening of the solenoid 86 allows the compressor 10 to return to a normal mode of operation.

Additionally, the vehicle is provided with a central processing unit 90 for receiving a signal that is generated by a pressure sensor 92 after air pressure in the air system has reached a predetermined upper threshold. Once this signal is processed, the solenoid 86 is actuated to block the outlet port 106.

Furthermore, the central processing unit 90, which is typically a computer, is able to process a signal indicating the overall load on the vehicle's engine. Thus, if a signal indicative of the load exceeds a certain threshold, the processing unit 90 generates a pilot signal actuating the solenoid 86, which closes the outlet port 106. In this case, the compressor rapidly achieves a state of equilibrium, as explained above, and stops compressing air. Since the reciprocal motion of the pistons 30 is arrested after the state of equilibrium is reached, the need for lubrication between the pistons 30 and the cylinder block 26 is reduced.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A valve assembly, comprising:

a housing;

a pump mechanism disposed in said housing;

a first plate mounted adjacent to said pump mechanism, said first plate having at least one aperture and at least one flexing flap;

a second plate mounted adjacent to and abutting said first plate, said second plate having at least one aperture and at least one flexing flap;

a compressor head mounted adjacent to said second plate, said compressor head having a discharge channel into which the at least one flap of said second plate opens;

wherein said first and second plates are aligned such that the at least one aperture in said first plate is located adjacent the at least one flexing flap in said second plate and the at least one aperture in said second plate is located adjacent the at least one flexing flap in said first plate; and at least one outlet port in said compressor head for discharging fluid that has passed through said plates.

2. The valve assembly as claimed in claim 1, further comprising at least one inlet port in said compressor head for introducing fluid to be passed through said plates.

3. The valve assembly as claimed in claim 1, further comprising an inlet port in said housing for introducing fluid to be passed through said plates.

4. The valve assembly as claimed in claim 1, wherein:

said at least one aperture in said first plate comprises a plurality of apertures located along the inner periphery of said first plate;

and the at least one aperture in said second plate comprises a plurality of apertures located along the outer periphery of said second plate.

5. The valve assembly as claimed in claim 1, wherein:

said at least one aperture in said first plate comprises a plurality of apertures located along the outer periphery of said first plate;

and the at least one aperture in said second plate comprises a plurality of apertures located along the inner periphery of said second plate.

6. The valve assembly as claimed in claim 1, wherein said pump mechanism comprises a compressor.

7. The valve assembly as claimed in claim 6, wherein said compressor is an air compressor.

8. The valve assembly as claimed in claim 6, wherein:

said housing comprises a first portion and a second portion;

the first portion comprises a cylinder block having at least one piston channel;

the second portion comprises a swash plate housing; and said pump mechanism comprises a swash plate disposed in said swash plate housing and at least one piston coupled to said swash plate and slidably disposed in the at least one piston channel.

9. The valve assembly as claimed in claim 8, further comprising a drive shaft disposed in said cylinder block and said swash plate housing, wherein said swash plate is mounted on said shaft.

10. The valve assembly as claimed in claim 9, further comprising an actuator mounted on said shaft for exerting a force on said swash plate.

11. A valve assembly, comprising:

a housing;

a pump mechanism disposed in said housing;

a first plate mounted adjacent to said pump mechanism, said first plate having at least one aperture and at least one flexing flap;

a second plate mounted adjacent to said first plate, said second plate having at least one aperture and at least one flexing flap;

a cover mounted adjacent to and abutting said second plate;

at least one inlet port in said cover for introducing fluid that is to be passed through said plates;

at least one outlet port in said cover for discharging fluid that has passed through said plates;

a first fluid pathway defined when the at least one flexing flap of said second plate is disposed against the at least one aperture of said first plate and the at least one flexing flap of said first plate is biased away from the at least one aperture of said second plate, in which fluid flows through said inlet port, through the at least one aperture in said second plate, past the at least one flexing flap in the first plate, and into said housing; and a second fluid pathway defined when the at least one flexing flap of said first plate is disposed against the at least one aperture of said second plate and the at least one flexing flap of said second plate is biased away from the at least one aperture of said first plate, in which fluid flows from said housing, through the at least one aperture in said first plate, past the at least one flexing flap in the second plate, and out said outlet port.

12. A valve assembly, comprising:

a swash plate housing at least partially enclosing a swash plate chamber;

a cylinder block mounted to said swash plate housing, said cylinder block having at least one passageway and at least one piston channel;

a pump mechanism disposed in said swash plate housing and cylinder block;

a first plate mounted adjacent to said cylinder block, said first plate having at least one aperture and at least one flexing flap;

a second plate mounted adjacent to said first plate, said second plate having at least one aperture and at least one flexing flap;

a cover mounted adjacent to said second plate;

at least one inlet port in said swash plate housing for introducing fluid that is to be passed through said plates;

at least one outlet port in said cover for discharging fluid that has passed through said plates;

a first fluid pathway defined when the at least one flexing flap of said second plate is disposed against the at least one aperture of said first plate and the at least one flexing flap of said first plate is biased away from the at least one aperture of said second plate, in which fluid flows through said inlet port and into said swash plate chamber, through the passageway, into said cover, through the at least one aperture in said second plate, past the at least one flexing flap in the first plate, and into the piston channel; and a second fluid pathway defined when the at least one flexing flap of said first plate is disposed against the at least one aperture of said second plate and the at least one flexing flap of said second plate is biased away from the at least one aperture of said first plate, in which fluid flows from the piston channel, through the at least one aperture in said first plate, past the at least one flexing flap in the second plate, and out said outlet port.

13. The valve assembly according to claim 1, wherein said second plate includes a plurality of the at least one flexing flaps, and wherein each of the plurality of the at least one flexing flaps opens into the discharge channel.

14. The valve assembly according to claim 1, further comprising:

a central processing unit; and a solenoid for closing said at least one outlet port in response to an actuation signal from said central processing unit.

15. The valve assembly according to claim 14, wherein the actuation signal is an on-demand signal from a driver.

16. The valve assembly according to claim 14, wherein the actuation signal is generated in response to said central processing unit receiving a load signal indicative of an engine load exceeding a predetermined value.

17. The valve assembly according to claim 14, wherein the actuation signal is generated in response to said central processing unit receiving a pressure signal indicative of an air pressure exceeding a predetermined value.

* * * * *